US011688541B2

(12) United States Patent
Njiende et al.

(10) Patent No.: US 11,688,541 B2
(45) Date of Patent: Jun. 27, 2023

(54) INTEGRATED MAGNETIC COMPONENT

(71) Applicant: DELTA ELECTRONICS (THAILAND) PUBLIC CO., LTD., Samutprakarn (TH)

(72) Inventors: Hugues Njiende, Paderborn (DE); Sergey Tikhonov, Bad Sassendorf (DE); Ralf Grieger, Soest (DE)

(73) Assignee: DET International Holding Limited, Grand Cayman (KY)

( * ) Notice: Subject to any disclaimer, the term of this patent is extended or adjusted under 35 U.S.C. 154(b) by 255 days.

(21) Appl. No.: 16/736,456

(22) Filed: Jan. 7, 2020

(65) Prior Publication Data

US 2020/0234867 A1 Jul. 23, 2020

(30) Foreign Application Priority Data

Jan. 18, 2019 (EP) ..... 19152630

(51) Int. Cl.
*H01F 17/06* (2006.01)
*H01F 3/14* (2006.01)
(Continued)

(52) U.S. Cl.
CPC ..... *H01F 17/062* (2013.01); *H01F 3/14* (2013.01); *H01F 27/027* (2013.01);
(Continued)

(58) Field of Classification Search
CPC ..... H01F 17/062; H01F 3/14; H01F 27/027; H01F 27/2895; H01F 27/306;
(Continued)

(56) References Cited

U.S. PATENT DOCUMENTS 5,313,176 A 5/1994 Upadhyay
5,731,666 A * 3/1998 Folker ..... H01F 3/12 315/276
(Continued)

FOREIGN PATENT DOCUMENTS

CN 102856036 B 2/2016
CN 107 293 389 A 10/2017
(Continued)

OTHER PUBLICATIONS

European Search Report dated Aug. 16, 2019, 11 pages.

*Primary Examiner* — Tuyen T Nguyen
(74) *Attorney, Agent, or Firm* — Vector IP Law Group; Robert S. Babayi

(57) ABSTRACT

An integrated magnetic component comprises a common mode inductance and a differential mode inductance. The common mode inductance is formed by a common mode core surrounding a winding window and at least two windings wound around the common mode core and through the winding window. The differential mode inductance is formed by the at least two windings and a differential mode core being spaced from the common mode core by a gap. The differential mode core comprises at least one surface being adjacent to each of the at least two windings. Further, a filter for attenuating electromagnetic interference comprises an integrated magnetic component according to the invention. Even further, the integrated magnetic component according to the invention is used for attenuating electromagnetic interference, preferably in a vehicle, a data center, or a telecommunication unit. A method for manufacturing an integrated magnetic component according to the invention comprises two steps. One step comprises providing a common mode inductance formed by a common mode core surrounding a winding window, and at least two windings wound around the core and through the winding window.
(Continued)

Another step comprises providing a differential mode core and spacing it from the common mode core by a gap, such that at least one surface of the differential mode core is adjacent to each of the least two windings.

6 Claims, 8 Drawing Sheets

(51) Int. Cl.

| | |
|---|---|
| ***H01F 27/02*** | (2006.01) |
| ***H01F 27/28*** | (2006.01) |
| ***H01F 27/30*** | (2006.01) |
| ***H01F 27/32*** | (2006.01) |
| *H01F 17/00* | (2006.01) |

(52) U.S. Cl.
CPC ..... *H01F 27/2895* (2013.01); *H01F 27/306* (2013.01); *H01F 27/324* (2013.01); *H01F 2017/0093* (2013.01); *H01F 2017/065* (2013.01)

(58) Field of Classification Search
CPC ..... H01F 27/324; H01F 2017/0093; H01F 2017/065; H01F 3/10; H01F 17/04; H01F 17/06; H01F 27/22; H01F 27/24; H01F 27/28; H01F 41/00
See application file for complete search history.

(56) References Cited

U.S. PATENT DOCUMENTS

| | | | |
|---|---|---|---|
| 6,480,088 | B2 | 11/2002 | Okamoto |
| 6,987,431 | B2 | 1/2006 | Tsai |
| 2002/0175571 | A1 | 11/2002 | Gilmore et al. |
| 2012/0319810 | A1 | 12/2012 | Tseng et al. |
| 2013/0049918 | A1 | 2/2013 | Fu et al. |
| 2014/0084790 | A1 | 3/2014 | Won et al. |
| 2015/0078054 | A1 | 3/2015 | Myhre et al. |

FOREIGN PATENT DOCUMENTS

| | | | | |
|---|---|---|---|---|
| DE | 19932475 | A1 | | 2/2001 |
| JP | S61-166509 | U | | 10/1986 |
| JP | 07101831 | A | * | 4/1995 |
| JP | 2599088 | B2 | | 4/1997 |
| JP | 09326323 | A | * | 12/1997 |
| KR | 101610337 | B1 | | 4/2016 |
| WO | 20180189170 | A1 | | 10/2018 |

* cited by examiner

INTEGRATED MAGNETIC COMPONENT

TECHNICAL FIELD

The invention relates to an integrated magnetic component comprising a common mode inductance and a differential mode inductance. The common mode inductance is formed by a common mode core surrounding a winding window and at least two windings wound around the common mode core and through the winding window. The differential mode inductance is formed by the at least two windings and a differential mode core being spaced from the common mode core by a gap. The invention further relates to filter for attenuating electromagnetic interference comprising an integrated magnetic component according to the invention. Even further, the invention relates to the use of an integrated magnetic component according to the invention. Also, the invention relates to a method for manufacturing an integrated magnetic component according to the invention.

BACKGROUND ART

Filter circuits to attenuate electromagnetic interferences (EMI) usually comprise a common mode choke and a differential mode choke.

A common mode choke is usually made of a highly permeable core, as for example a ferrite core, and the inductance of a common mode choke, also called the common mode inductance, can be as high as approximately 1-50 mH. The load current flows through the coils wound on the core. A coil is also called a winding, and each coil or winding may comprise one or a multitude of turns of a wire. The coils are arranged such that the magnetic fluxes inside the core cancel out. Thus, core saturation will not occur. To achieve a high common mode inductance, the two coils are coupled as good as possible. Preferably, toroidal cores or one-piece cores of ET type and UT type are used. However, toroidal cores have the disadvantage of high production cost.

The differential mode choke is usually split in several chokes with each thereof arranged in one path of the load current. These chokes are magnetically not coupled and, therefore, can saturate. The differential mode choke has a differential mode inductance.

In order to save space and cost, it has been proposed to combine the common mode choke and the differential mode choke into one single filter choke by using the leakage inductance of the common mode choke as the differential mode choke and omitting the traditional differential choke. However, the leakage inductance of the common mode choke is usually very small compared to the common mode inductance thereof, typically a factor of 100-1000 smaller, which is insufficient to serve as a differential choke. Therefore, several ways have been proposed to increase the leakage inductance of the common mode choke.

In general, the leakage inductance of the common mode choke is primarily controlled by the design of the coils and the geometry of the core. Increasing the distance of the coils from the core and/or from each other has the disadvantage of increasing the size of the choke. Reducing the coupling between the coils results also in an increased leakage inductance. However, this reduces the common mode inductance.

Another way to increase the leakage inductance of the common mode choke is to provide a magnetic shortcut within the core of the common mode choke, that is to say a magnetic short cut within the common mode core. However, such a magnetic shortcut is sensitive to saturation which must be avoided in any case. Therefore, an airgap is usually arranged between the magnetic shortcut and the core of the common mode choke. However, the airgap may reduce the electrical insulation between the coils of the common mode choke which also must be avoided in any case. Therefore, separators made of an insulating material, such as plastics are traditionally used at locations of the common mode choke where the magnetic shortcut has been proposed. The airgap is also called "gap". As the gap refers to the magnetic properties of a core, that is to say a gap of the highly permeable material, it makes no difference whether the gap is filled by air or another low permeable material like typical insulation materials or wires as for example copper wires of a winding.

In the following, several prior art examples are discussed with respect to electrical insulation of the coils as well as using the leakage induction of a common mode choke to serve as a combined common mode and differential mode choke.

U.S. Pat. No. 6,987,431 (Delta) discloses an electromagnetic interference filter including an inductance coil with four wires extended therefrom, a ceramic capacitance board, a metallic film capacitance and a grounded wire. However, the coil is not suitable to attenuate both common mode and differential mode interferences.

DE 19932475 A1 (Vacuumschmelze) discloses a ring core carrying windings separated by a partition resiliently pressing its ends against the core. The partition provides the required air- and creepage distances, for example according to EN 138000. However, the choke formed by the core carrying the winding is not suitable to attenuate differential mode interferences.

CN 102856036 (Emerson Network Power) discloses a difference and common mode integrated inductor suppressing both difference mode and a common mode electromagnetic interference. The integrated inductor comprises a closed type magnetic core and two coil windings symmetrically wound therearound. The closed toroidal core may be divided into two half rings through a partition plate. Further, an electromagnetic interference filter and a switched power source are disclosed. By adopting the difference and common mode integrated inductor, the size of the inductor can be minimized and heat radiation area thereof can be maximized. However, it remains questionable if the differential mode inductance is sufficient for a typical EMI filtering application.

US 2015 0078054 A1 (Eltek) discloses a common mode inductor device including a magnetic core forming a continuous loop, a first winding wound around the magnetic core and a second winding wound around the magnetic core. A separation plate is made of a plastic material or other known PCB-material. Again, it remains questionable whether the inductor is suitable to attenuate differential mode interferences.

JP 2599088 discloses a surface mount type noise filter for suppressing electromagnetic noise using a winding type toroidal coil. A central divider made of resin like silicone fixes the toroidal coil in the case. The filter suppresses the common mode noise. However, the filter seems to be not suitable to attenuate differential mode interferences.

JP S61-166509(U) discloses a combined normal (differential) mode choke and common mode choke with a platy magnetic body inserted into a concave part arranged in the internal space of a toroidal core.

KR 101610337 discloses a coil component operating as a common mode filter in a main core and coil, and a leakage inductance generated through an auxiliary core operating as a differential mode filter. Thus, one coil component can provide both common mode and differential mode filter functions. An insertion groove is formed in the main core in a shape corresponding to the outer shape of the auxiliary core, which can be a plate for example. To avoid magnetic saturation in the auxiliary core, the distance between the main core and the auxiliary core can be adjusted. However, the insertion groove reduces the common mode inductivity and requires additional manufacturing effort.

US 2014 0084790 A1 (Samsung) discloses an electromagnetic interference filter for removing common mode electromagnetic interference. For removing differential mode interferences, a differential mode choke is separately employed as well as X-capacitors.

U.S. Pat. No. 6,480,088 (Minebea) discloses a common mode choke in which countermeasures against leakage flux are taken. A substantially U-shaped magnetic shield plate (or belt) made of a soft magnetic material covers a toroidal core and is set in a direction of a plastic insulating partition plate located within the internal space of the toroidal core and between the ends of the windings around the core. Although the magnetic shield plate might increase the leakage inductance of the common mode choke, it remains questionable if the differential mode inductance is sufficient for a typical EMI filtering application.

U.S. Pat. No. 5,731,666 A (Magnetek) discloses an integrated magnetic filter that provides both common mode and differential mode inductance. The inductors have cores composed of more than one material. The magnetic core has a high-permeability C-core, a high-permeability I-core, and a low-permeability, lossy shunt. This core is easier to manufacture than prior-art cores which utilize an air gap produced by grinding the center leg of an E-core piece. However, the low-permeability, lossy shunt does not provide the highest possible leakage inductance.

U.S. Pat. No. 5,313,176 A (Motorola) discloses an integrated EMI/RFI (radio frequency interference) filter magnetic which has differential and common mode inductors wound about an I-core. The I-core is juxtaposed with an E-core, with the end surfaces of the E-core legs facing the I-core. The magnetic has a substantially closed magnetic path for the differential inductors and the common mode inductors. However, the airgap between the I-core and the E-core might reduce the insulation properties between the coils.

SUMMARY OF THE INVENTION

It is the object of the invention to create a combined common mode and differential mode choke pertaining to the technical field initially mentioned, that provides an even more increased leakage inductance compared to prior art. Further objectives are to provide a combined choke with improved electrical insulation of the coils, with improved heat dissipation of the coils, with a compact design, and easy to manufacture.

The solution of the invention is specified by the features of claim 1. According to the invention, an integrated magnetic component comprises a common mode inductance and a differential mode inductance. The common mode inductance is formed by a common mode core surrounding a winding window and at least two windings wound around the common mode core and through the winding window. The differential mode inductance is formed by the at least two windings and a differential mode core being spaced from the common mode core by a gap. The differential mode core comprises at least one surface being adjacent to each of the at least two windings.

In general, an integrated magnetic component comprising both a common mode inductance and a differential mode inductance can be built much smaller and less costly than two separate magnetic components with one having the same common mode inductance and another one having the same differential mode inductance as the integrated magnetic component. Consequently, the power density is substantially increased. Further, ohmic losses are reduced as the at least two windings are used for both the common mode inductance as well as the differential mode inductance, i.e. there is no need for separate windings for the common mode inductance and the differential mode inductance.

Experiments have shown that the differential mode inductance of the integrated magnetic device according to the invention is a factor of 5-10 larger compared to prior art. The at least one surface being adjacent to each of the at least two windings can concentrate substantial leakage flux caused by the arrangement consisting of the common mode core and the at least two windings when a current is flowing therethrough. Therefore, the integrated magnetic component according to the invention can have a more compact design and smaller size resulting in a higher energy density.

Another advantage of the invention is that the at least one surface being adjacent to each of the at least two windings does not necessarily have to completely enclose the at least two windings and, thereby, may allow for an efficient and effective heat dissipation of the at least two windings.

If the at least one surface were enclosing the at least two windings completely, the differential mode inductance would be increased most. To allow for sufficient heat dissipation of the common mode core and/or the at least two windings, a thermally conducting magnetic material could be used for example.

The meaning of "adjacent" is that the at least one surface is arranged directly next to each of the at least two windings, or in other words, there is no air gap between the at least two windings and the at least one surface, or at least there is essentially no air gap between the at least two windings and the at least one surface. Of course, a bobbin and/or an insulator can be placed between the at least one surface and the at least two windings in order to meet insulation requirements between the at least two windings and the differential mode core and/or the common mode core. The meaning of "adjacent" is also to be understood as to maximize the leakage inductance of the arrangement consisting of the common mode core and the at least two windings, preferably without reducing the common mode inductance thereof. The meaning of "adjacent" can also be "fitting", "tight-fitting" or "close-fitting".

Preferably, the common mode core is a closed loop core. Thus, a large common mode inductance can be achieved. A closed loop core is void of an air gap.

A surface shall be defined as a plane or curved two-dimensional locus of points. According to this definition, a plate has (at least) two surfaces, for example an upper surface and a lower surface. A pipe also has at least two surfaces, an outer cylindrical surface and an inner cylindrical surface. A cube has six surfaces, an upper, lower, front, back, right and left surface. Each of these six surfaces is a plane.

The differential mode core can be massive or hollow. In case of a hollow differential mode core, the wall thickness of the differential mode core can be small. Such differential mode cores are easy and/or cost effective to manufacture, and they are easy to mount. Further, such differential mode cores may have a lower risk of breakage compared to for example cup cores. Also, the cooling of such differential mode cores can be better compared to for example cup cores. In addition, the differential mode core can be arranged within the integrated magnetic component depending on the available space therein and/or there around. In other words, a flexible arrangement of the differential mode core is possible. A cross-section of the differential mode core can have a small area, in particular, the area of the cross section can be much smaller than the area of the at least one surface.

The gap ensures that there will be no saturation in the differential mode core.

Preferably, the at least two windings are two windings, three windings, or four windings. Two windings are preferably used in single phase applications, three windings are preferably used in two phase applications, and four windings are preferably used in three phase applications.

In a preferred embodiment, the at least one surface is an edgeless surface.

Such surfaces are easy to manufacture. Further, such surfaces can concentrate the leakage flux especially well when being arranged adjacent to the at least two windings.

For example, such a surface can be the outer surface of a cylinder, a pipe, a rod, one side of a plate, one side of a cuboid, or one side of a band or foil.

Alternatively, the at least one surface could have edges, as for example if taking two sides of a cuboid.

In another preferred embodiment, the at least one surface is adjacent to each turn of the at least two windings.

Such surfaces can concentrate even more of the leakage flux and, thereby, even further increase the differential mode inductance of the integrated magnetic component.

If the at least one surface is adjacent to each turn of the at least two windings, the distance between each turn of the at least two windings and the at least one surface is void of an air gap.

However, it is also possible that the at least one surface is adjacent to only some of the turns of the at least two windings, that is to say to a portion of the turns of the at least two windings.

In another preferred embodiment, each turn of the at least two windings is going through the gap.

As mentioned earlier, the gap, or air gap, is needed to avoid saturation of the differential mode core. By shaping and arranging the differential mode core such that each turn of the at least two windings is going through the gap, the energy density can further be increased. Also, by filling the gap with electrically insulated wires which form the turns of the windings, the creeping distances within the integrated magnetic component can be extended.

It is also possible that only some turns of the at least two windings are going through the gap. Advantageously, more than 75% of the turns are going through the gap, more advantageously, more than 90% of the turns are going through the gap, and most advantageously, more than 95% of the turns are going through the gap.

In another preferred embodiment, the gap has a length which is constant.

The length of the gap shall be understood as the length of the gap in the direction of the magnetic flux. The length of the gap influences the saturation in the differential mode core. The advantage of a gap with a constant length is that for example at each place of the gap an equal amount of turns of the at least two windings can be arranged, for example one layer of turns, or two layers of turns, and so on, without wasting any space.

However, it is also possible, to have a gap with a varying length, that is to say a length which varies from place to place of the gap.

In another preferred embodiment, the at least one surface is closer to the common mode core than at least one other surface of the differential mode core.

In other words, a distance between the at least one surface and the common mode core is shorter than any other distance between the differential mode core and the common mode core. Differential mode cores having such a surface can concentrate even more of the leakage flux and, thereby, even further increase the differential mode inductance of the integrated magnetic component.

It is also possible that the at least one surface is closer to the common mode core than any other surface of the differential mode core. Also it is possible, that at least one other surface of the differential mode core is closer to the common mode core than the at least one surface.

In another preferred embodiment, a shortest distance between the at least one surface and each winding of the at least two windings is essentially equal to a shortest distance between the common mode core and each winding of the at least two windings.

This arrangement ensures a small size of the integrated magnetic component and, thereby, a high power density.

Preferably, a shortest distance between the at least one surface and each winding of the at least two windings is essentially identical.

In both cases, the expression "essentially" means that a difference in distances caused by bobbins or insulation material of the wires of the windings shall be neglected. Or in other words, any distance caused by bobbins or insulation material of the wires does not count as a distance within this invention description. Also, an insulator ensuring a predetermined gap to avoid saturation of the differential mode core does not count as a distance, accordingly. However, any insulation material molded into the integrated magnetic component after having wound all windings and after having the differential mode core placed at its intended position, would count as a distance for example.

It is also possible that the shortest distance between the at least one surface and one of the at least two windings is essentially equal to a shortest distance between the common mode core and each winding of the at least two windings.

Also, it is possible that the average or maximum distance between the at least one surface and each winding of the at least two windings is essentially equal to the average or maximum distance between the common mode core and each winding of the at least two windings.

It is also possible that the shortest, average or maximum distance between the at least one surface and each winding of the at least two windings is essentially equal to a shortest distance between the common mode core and each winding of the at least two windings.

In another preferred embodiment, the common mode core is a toroidal core and the differential mode core comprises a rod or a pipe arranged in the winding window.

A toroidal core ensures a good common mode inductivity. As a toroidal core usually has a circular winding window which is partly occupied by the at least two windings, a rod or a pipe with a circular cross-section can perfectly fit in the remaining space of the winding window. In addition, the rod has the advantage of a large cross-section and does not need an additional gap, that is to say a gap larger than a gap caused by the at least two windings, when placed in the winding window of the common mode core with the at least two windings wound therearound. This is an advantage over the rectangular bars commonly used as a differential mode core which require a dedicated gap. Experiments have shown that a differential mode core comprising a rod or a pipe leads to a differential mode inductance being a factor of two or more higher than prior art differential mode inductances.

In this embodiment, the outer cylindrical surface of the rod or of the pipe forms the at least one surface. The rod and/or the pipe may have a circular cross-section. Preferably, the rod or the pipe are arranged within the winding window such that a longitudinal axis of the rod or the pipe does not touch or hit the common mode core.

It is also possible that the differential mode core comprises a magnetic band or foil, for example wound around the at least two windings. The magnetic band or foil can be made of a thermally conducting magnetic material to ensure good heat dissipation. The magnetic band or foil can be completely or partly wound around the at least two windings. A magnetic band or foil would also provide a magnetic shielding.

Also, it is possible that the differential mode core, and in particular the at least one surface thereof, comprises a layer of a magnetic material completely or partly surrounding the at least two windings. The layer can be made for example by applying a magnetic spray, in particular by applying a magnetic spray on the at least two windings and/or winding bobbins thereof. Such a magnetic layer would also provide a magnetic shielding.

In another preferred embodiment, the common mode core is a rectangular core.

A rectangular core ensures also a good common mode inductivity.

Preferably, the differential mode core is a cuboid or a hollow cuboid, in particular a rectangle cuboid.

As a rectangular core usually has a rectangular winding window which is partly occupied by the at least two windings, a differential mode core having the shape of a cuboid or a hollow cuboid can perfectly fit in the remaining space of the winding window.

Preferably, each of the at least two windings is wound on a different leg of the rectangular core. However, it is also possible that the at least two windings are wound on one and the same leg off the rectangular lab core.

Also for this embodiment it is possible that the differential mode core comprises a magnetic band or foil, for example wound around the at least two windings. The magnetic band or foil can be made of a thermally conducting magnetic material to ensure good heat dissipation. The magnetic band of foil can be completely or partly wound around the at least two windings. A magnetic band or foil would also provide a magnetic shielding.

In another preferred embodiment, the differential mode core comprises a plate.

A plate can be easily arranged on top of or under the common mode core with the at least two windings wound therearound, regardless whether the common mode core is a toroidal core or a rectangular core. The plate has also the advantage of providing a magnetic shielding, that is to say a reduced magnetic field in the vicinity of the integrated magnetic component according to the invention.

In this case, the upper or lower outer surface of the plate forms the at least one surface.

The plate can be made of a material having a high permeability or having a low permeability. In the latter case, only a small gap is needed.

Preferably, the plate can be combined with a rod, pipe, or cuboid to form the differential mode core. In this case, the differential mode core might have two surfaces (one of the plate, and one of the rod, pipe or cuboid) with each of the two surface being adjacent to each of the at least two windings. Such a differential mode core is in particular capable of concentrating substantial leakage field and achieving high differential mode inductance.

It is also possible, that the differential mode core comprises several plates. Such plates can be arranged on top of, under, and/or any other outer surface of the common mode core or the at least two windings, respectively.

In another preferred embodiment, the plate has a hole.

A plate having a hole requires less material than a plate without hole, therefore, such a plate can be lighter.

The hole can for example be a circular hole or a rectangular hole.

The hole can be arranged in such parts of the plate, where only little leakage field or flux is concentrated. In particular, the hole can be arranged in such areas of the plate, which have a distance from the at least two windings being a factor of two, three, five or even ten larger than the shortest distance from the plate to the at least two windings.

Preferably, the plate with a hole can be combined with a rod, pipe, cuboid, of further plates without holes. In this case, the differential mode core might have two surfaces (one of the plate, and one of the rod, pipe or cuboid) with each of the two surface being adjacent to each of the at least two windings. Such a differential mode core is in particular capable of concentrating substantial leakage field and achieving high differential mode inductance.

In another preferred embodiment, an insulator is arranged between the differential mode core and the at least two windings and/or between the differential mode core and the common mode core.

The insulator ensures good electrical insulation between the differential modes core and the at least two windings, and/or between the differential mode core and the common mode core.

Such an insulator can be a bobbin. However, it is also possible to use a coated differential mode core with the coating being insulating.

According to another aspect of the invention, a filter for attenuating electromagnetic interference comprises an integrated magnetic component according to the invention.

Such a filter has the advantage of being suitable for both common mode and differential mode EMI attenuation. Also, such a filter can have a smaller size because of the reduced size of the integrated magnetic component.

According to another aspect of the invention, the integrated magnetic component according to the invention is used for attenuating electromagnetic interference, preferably in a vehicle, a data center, or a telecommunication unit.

Due to the space requirements in vehicles, data centers, and/or telecommunications, the integrated magnetic component according to the invention can be used in these fields of applications with advantage.

According to another aspect of the invention, a method for manufacturing an integrated magnetic component, in particular an integrated magnetic component according to the invention, comprises the steps of a) providing a common mode inductance formed by a common mode core surrounding a winding window, and at least two windings wound around the common mode core and through the winding window, and
b) providing a differential mode core and spacing it from the common mode core by a gap, such that at least one surface of the differential mode core is adjacent to each of the least two windings.

This method allows for a simple and cost-effective manufacturing of the integrated magnetic component according to the invention.

The at least one surface could also, regardless whether completely or partly surrounding the windings, be made by applying a magnetic spray, in particular by applying a magnetic spray on the at least two windings and/or winding bobbins thereof.

Other advantageous embodiments and combinations of features come out from the detailed description below and the totality of the claims.

BRIEF DESCRIPTION OF THE DRAWINGS

The drawings used to explain the embodiments show.

In the figures, the same components are given the same reference symbols.

PREFERRED EMBODIMENTS

Figure 1:
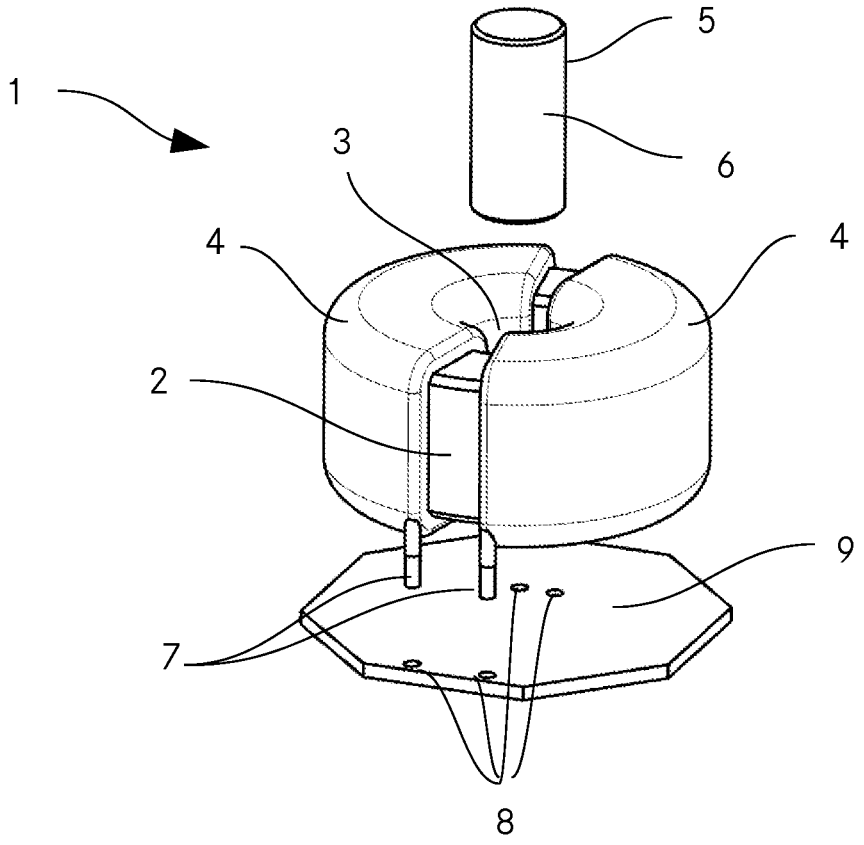
FIG. 1 an exploded view of an integrated magnetic component with a toroidal common mode core and a rod-shaped differential mode core, FIG. 2 an assembled integrated magnetic component with a toroidal common mode core and a rod-shaped differential mode core, FIG. 3 an exploded view of an integrated magnetic component with a toroidal common mode core and a rod-shaped differential mode core with a flat insulator, FIG. 4 an exploded view of an integrated magnetic component with a toroidal common mode core and a rod-shaped differential mode core with a tubular insulator, FIG. 5 an exploded view of an integrated magnetic component with a toroidal common mode core and a plate-shaped differential mode core arranged above the common mode core, FIG. 6 an exploded view of an integrated magnetic component with a toroidal common mode core and a plate-shaped differential mode core arranged under the common mode core, FIG. 7 an exploded view of an integrated magnetic component with a rectangular common mode core and a plate-shaped differential mode core arranged above the common mode core, FIG. 8 an exploded view of an integrated magnetic component with a rectangular common mode core and a plate-shaped differential mode core arranged under the common mode core, FIG. 9 an exploded view of an integrated magnetic component with a toroidal common mode core and a plate-shaped differential mode core with a hole, FIG. 10 an exploded view of an integrated magnetic component with a toroidal common mode core and two plate-shaped differential mode cores, FIG. 11 an exploded view of an integrated magnetic component with a rectangular common mode core and a plate-shaped differential mode core with a hole, FIG. 12 an exploded view of an integrated magnetic component with a rectangular common mode core and two plate-shaped differential mode cores, FIG. 13 an exploded view of an integrated magnetic component with a toroidal common mode core and two plate-shaped differential mode cores with one of them having a hole, FIG. 14 an exploded view of an integrated magnetic component with a rectangular common mode core and two plate-shaped differential mode cores with one of them having a hole, FIG. 15 an exploded view of an integrated magnetic component with a toroidal common mode core and a differential mode core comprising both a rod and a plate, FIG. 16 an exploded view of an integrated magnetic component with a rectangular common mode core and a differential mode core comprising both a rectangular cuboid and a plate, FIG. 17 an exploded view of an integrated magnetic component with a toroidal common mode core and a differential mode core comprising both a rod and two plates, FIG. 18 an exploded view of an integrated magnetic component with a rectangular common mode core and a differential mode core comprising both a rectangular cuboid and two plates, FIG. 19 an exploded view of an integrated magnetic component with a toroidal common mode core and a differential mode core comprising two parts with each of them having both a rod and a plate, and FIG. 20 an exploded view of an integrated magnetic component with a rectangular common mode core and a differential mode core comprising two parts with each of them having both a rectangular cuboid and a plate.

FIG. 1 shows an exploded view of an integrated magnetic component 1 with a toroidal common mode core 2. Two windings 4 are wound around the common mode core 2 and through the winding window 3. A rod-shaped differential mode core 5 comprises one surface 6 which, when placed within the remaining space of the winding window 3, is adjacent to each of the two windings 4 (see also FIG. 2). The surface 6 of rod-shaped differential mode core 5 has the same distance to each of the two windings 4 as the common mode core 2 has. In other words, the two windings 4 are wound tightly around the common mode core 2, and the rod-shaped differential mode core 5 fits tightly into the remaining space of the winding window 3. Each of the two windings 4 comprises two terminals 7 (only one terminal per winding is shown) which are arranged to pass through openings 8 of a printed circuit board (PCB) 9.

Figure 2:
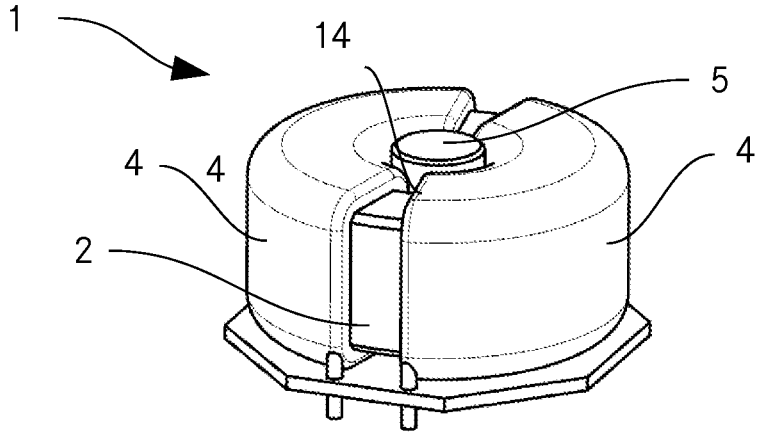

FIG. 2 shows an assembled integrated magnetic component 1 according to FIG. 1 with a toroidal common mode core 2 and a rod-shaped differential mode core 5. The rod-shaped differential mode core 5 is placed such that it concentrates substantial leakage field of the common mode inductance and, thereby, achieves a high differential mode inductance. Gap 14 is located between the differential mode core 5 and the common mode core 2. All turns of the two windings 4 are located in the gap 14.

Figure 3:
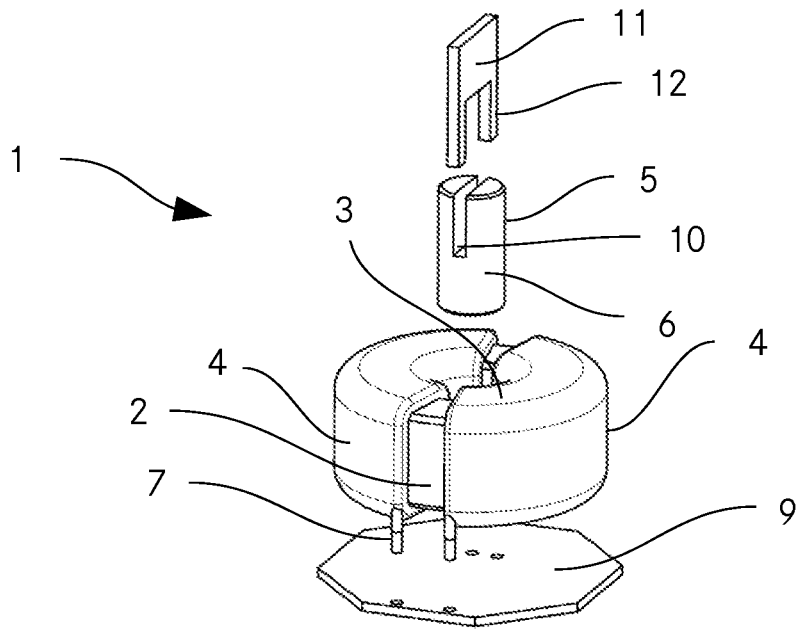

FIG. 3 shows an exploded view of an integrated magnetic component 1 with a toroidal common mode core 2 and a rod-shaped differential mode core 5. In addition to the embodiment shown in FIG. 1 and FIG. 2, the embodiment shown in FIG. 3 comprises a flat insulator 11 which can be placed, for example, in a groove 10 of differential mode core 5. The flat insulator 11 may also comprise two guiding protrusions 12 which may also serve as insulation between the two windings 4.

Figure 4:
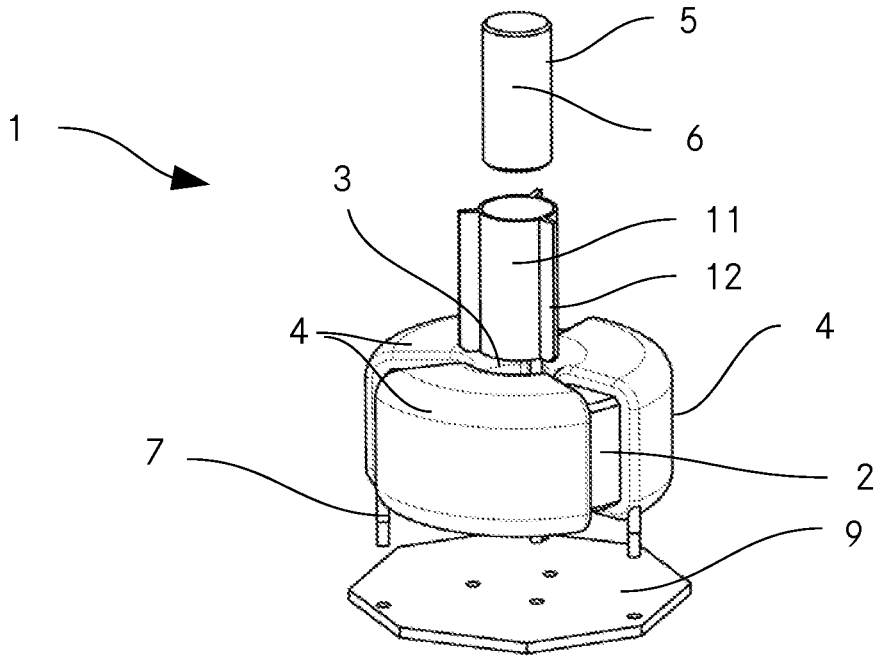

FIG. 4 shows an exploded view of an integrated magnetic component 1 with a toroidal common mode core 2 and three windings 4 wound therearound, preferably for use in phase applications. Rod-shaped differential mode core 5 with one surface 6 can be placed in a tubular insulator 11 with three guiding protrusions 12. The three guiding protrusions 12 may also serve as insulation between the three windings 4.

Figure 5:
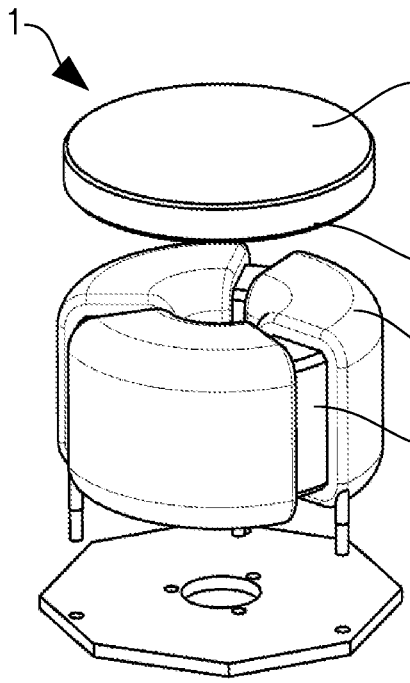

FIG. 5 shows an exploded view of an integrated magnetic component 1 with a toroidal common mode core 2 and three windings 4 wound therearound. Instead of a rod-shaped differential mode core, a circular plate-shaped differential mode core 5 is arranged above the common mode core 2. One surface 6 cannot be seen in FIG. 5 as the one surface 6 is located at the lower side of plate-shaped differential mode core 5.

Figure 6:
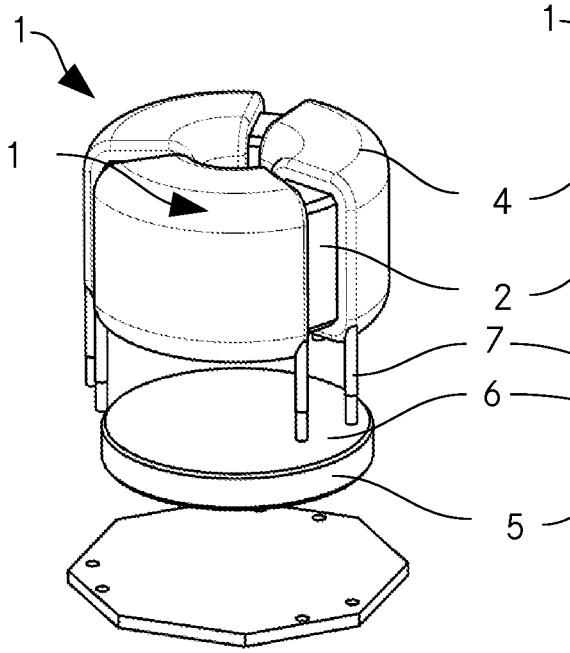

FIG. 6 shows also an exploded view of an integrated magnetic component 1 with a toroidal common mode core 2 and three windings 4 wound therearound. However, the circular plate-shaped differential mode core 5 is arranged under the common mode core 2. One surface 6 can now be seen as it is located at the upper side of plate-shaped differential mode core 5. Plate-shaped differential mode core 5 is sized to fit between terminals 7 when placed directly under common mode core 2.

Figure 7:
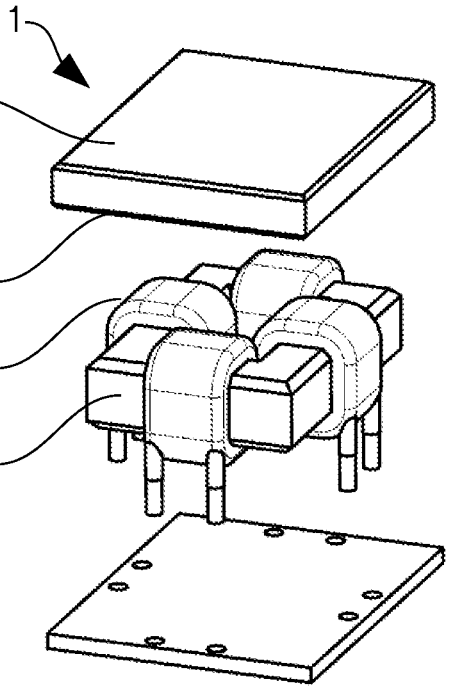

FIG. 7 shows an exploded view of an integrated magnetic component 1 with a rectangular common mode core 2 and four windings 4 wound therearound and, therefore, being preferred for three-phase applications. A rectangular plate-shaped differential mode core 5 is arranged above the common mode core 2. One surface 6 cannot be seen in FIG. 7 as the one surface 6 is located at the lower side of plate-shaped differential mode core 5.

Figure 8:
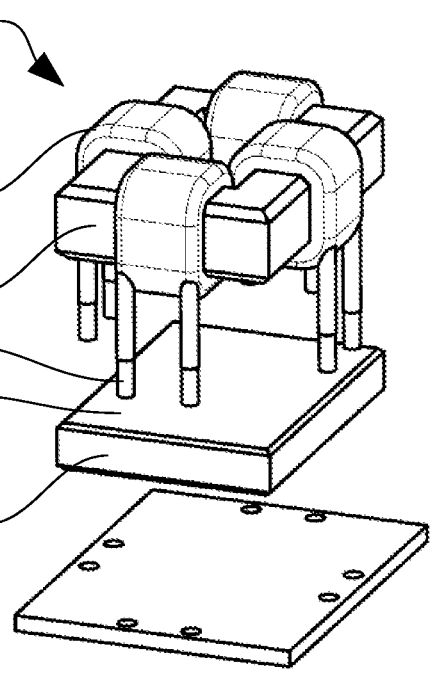

FIG. 8 shows also an exploded view of an integrated magnetic component 1 with a rectangular common mode core 2 and four windings 4 wound therearound. However, the rectangular plate-shaped differential mode core 5 is arranged under the common mode core 2. One surface 6 can now be seen as it is located at the upper side of plate-shaped differential mode core 5. Plate-shaped differential mode core 5 is sized to fit between terminals 7 when placed directly under common mode core 2.

Figure 9:
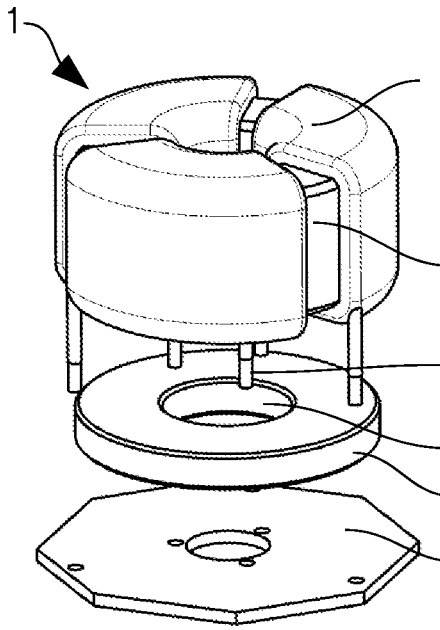

FIG. 9 shows an exploded view of an integrated magnetic component 1 with a toroidal common mode core 2 and three windings 4 wound therearound. A circular plate-shaped differential mode core 5 is arranged under the common mode core 2. Plate-shaped differential mode core 5 comprises a hole 13 to allow some of the terminals 7 to pass therethrough in order to be connected to the printed circuit board 9. Plate-shaped differential mode core 5 is sized to fit between terminals 7 when placed directly under common mode core 2.

Figure 10:
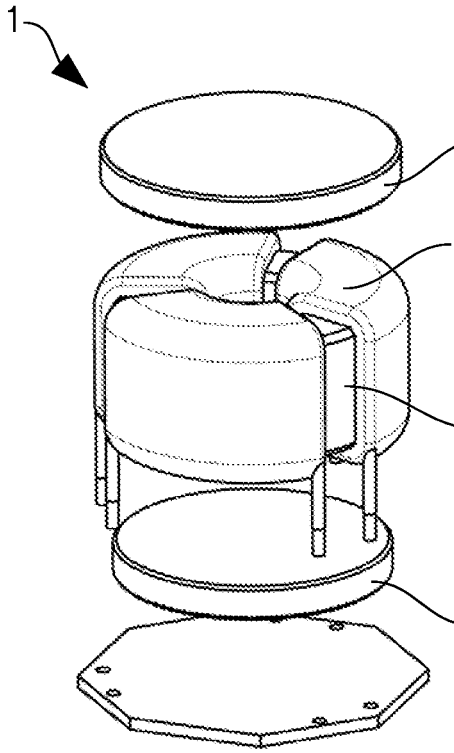

FIG. 10 shows an exploded view of an integrated magnetic component 1 with a toroidal common mode core 2 and three windings 4 wound therearound. However, a circular plate-shaped differential mode core 5 is arranged above the common mode core 2 and another circular plate-shaped differential mode core 5 is arranged under the common mode core 2.

Figure 11:
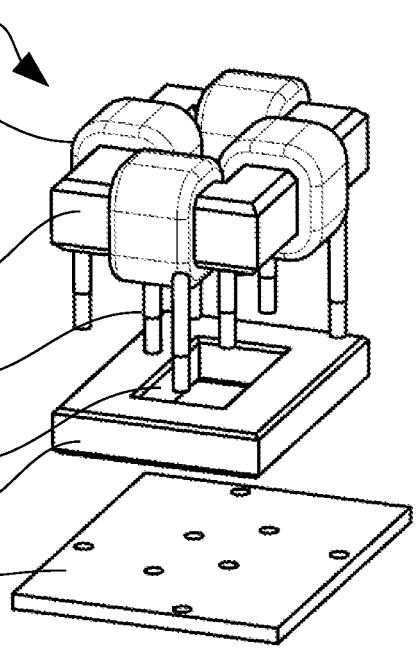

FIG. 11 shows an exploded view of an integrated magnetic component 1 with a rectangular common mode core 2 and four windings 4 wound therearound. A rectangular plate-shaped differential mode core 5 is arranged under the common mode core 2. Plate-shaped differential mode core 5 comprises a hole 13 to some of the terminals 7 to pass therethrough in order to be connected to the printed circuit board 9. Plate-shaped differential mode core 5 is sized to fit between terminals 7 when placed directly under common mode core 2.

Figure 12:
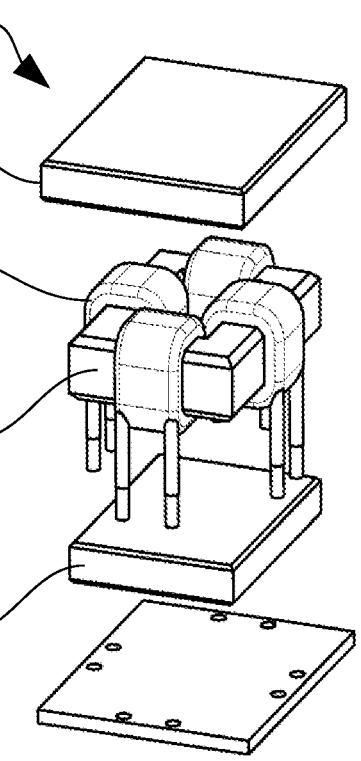

FIG. 12 shows an exploded view of an integrated magnetic component 1 with a rectangular common mode core 2 and four windings 4 wound therearound. However, a rectangular plate-shaped differential mode core 5 is arranged above the common mode core 2 and another rectangular plate-shaped differential mode core 5 is arranged under the common mode core 2.

Figure 13:
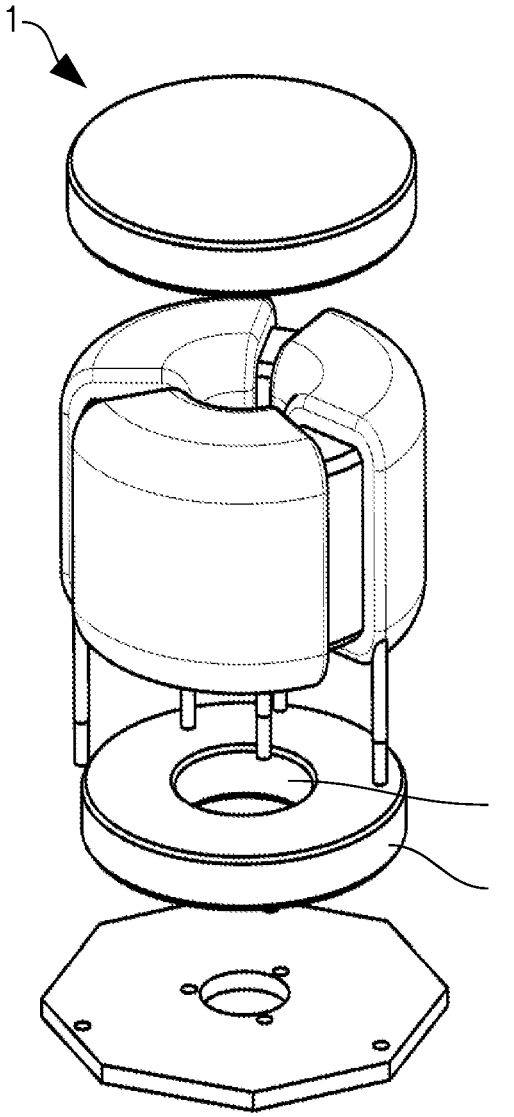

The embodiment shown in FIG. 13 differs from that shown in FIG. 10 in that the circular plate-shaped differential mode core 5 located under the common mode core 2 comprises a hole 13.

Figure 14:
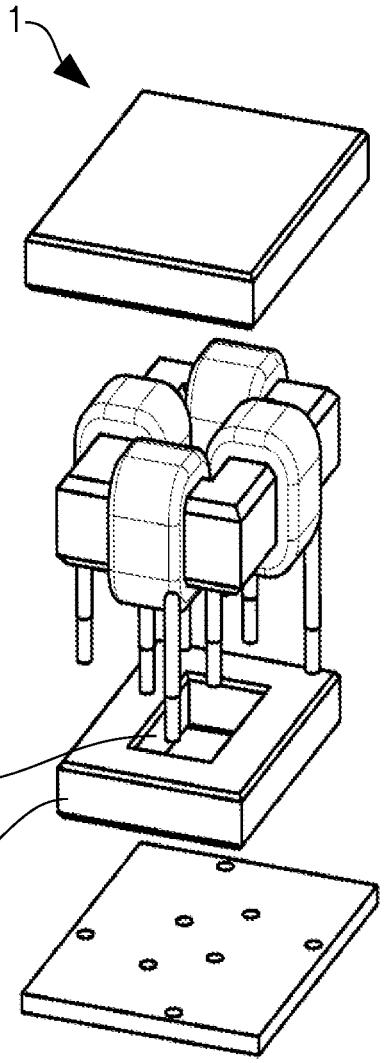

The embodiment shown in FIG. 14 differs from that shown in FIG. 11 in that the rectangular plate-shaped differential mode core 5 located under the common mode core 2 comprises a hole 13.

Figure 15:
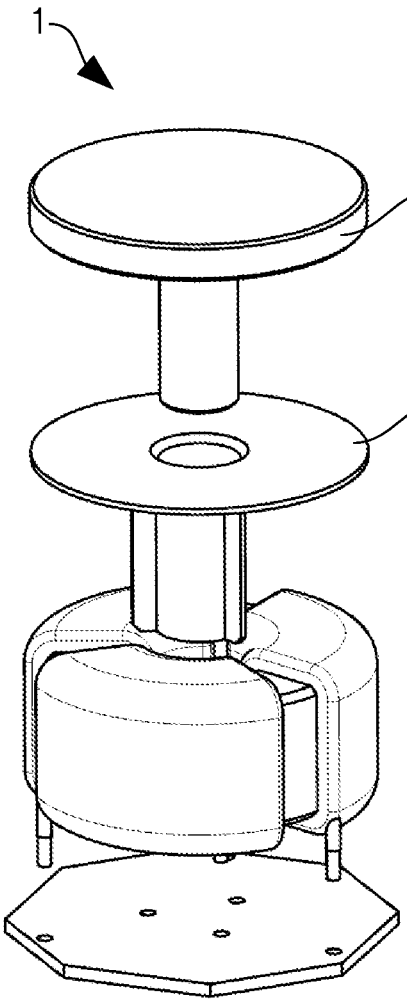

The embodiment shown in FIG. 15 differs from the previous embodiments in that differential mode core 5 comprises both a circular plate and a rod, and in that insulator 11 comprises both a tubular insulator with guiding protrusions and a plate-shaped insulator.

Figure 16:
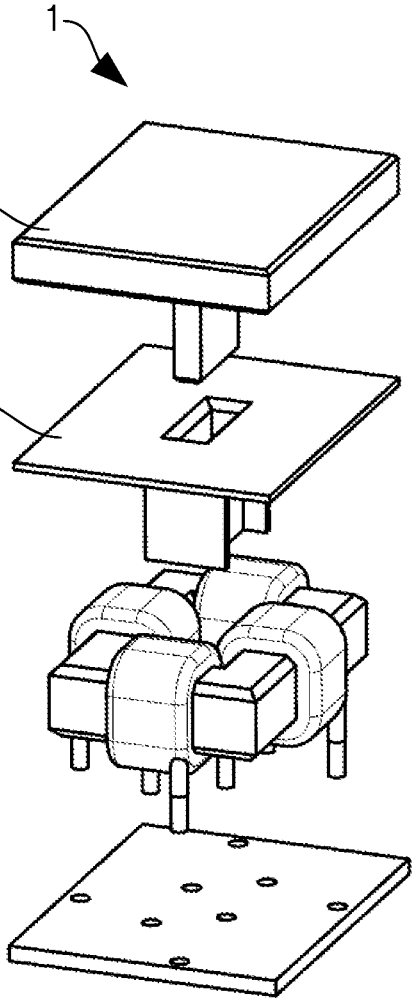

The embodiment shown in FIG. 16 differs from the previous embodiments in that differential mode core 5 comprises both a rectangular plate and a rectangular cuboid, and in that insulator 11 comprises both a rectangular-profiled insulator with guiding protrusions and a plate-shaped insulator.

Figure 17:
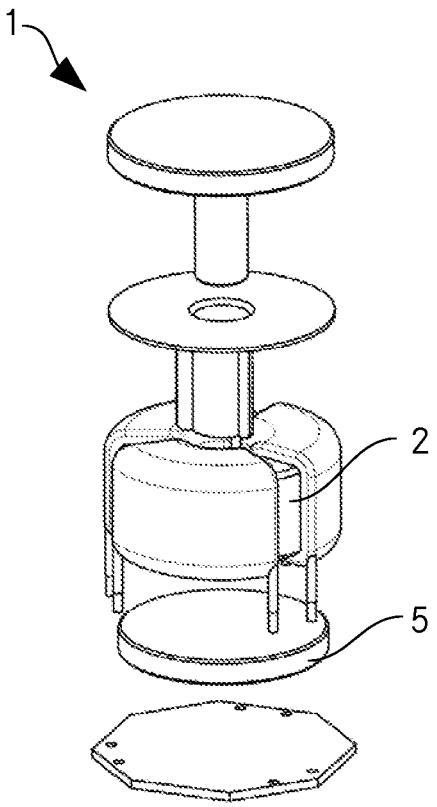

The embodiment shown in FIG. 17 differs from the embodiment shown in FIG. 15 in that the embodiment shown in FIG. 17 comprises a further circular differential mode core 5 which is arranged under common mode core 2.

Figure 18:
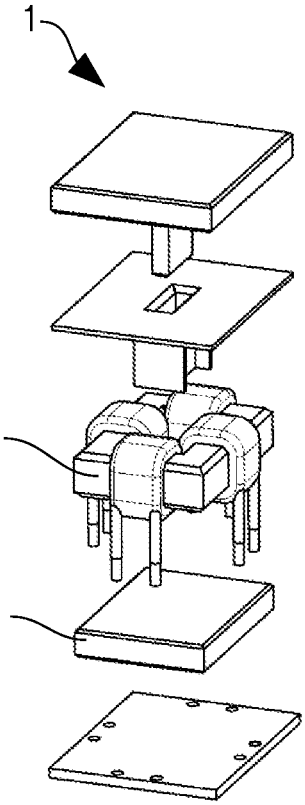

The embodiment shown in FIG. 18 differs from the embodiment shown in FIG. 16 in that the embodiment shown in FIG. 18 comprises a further rectangular differential mode core 5 which is arranged under common mode core 2.

Figures 19, 20:
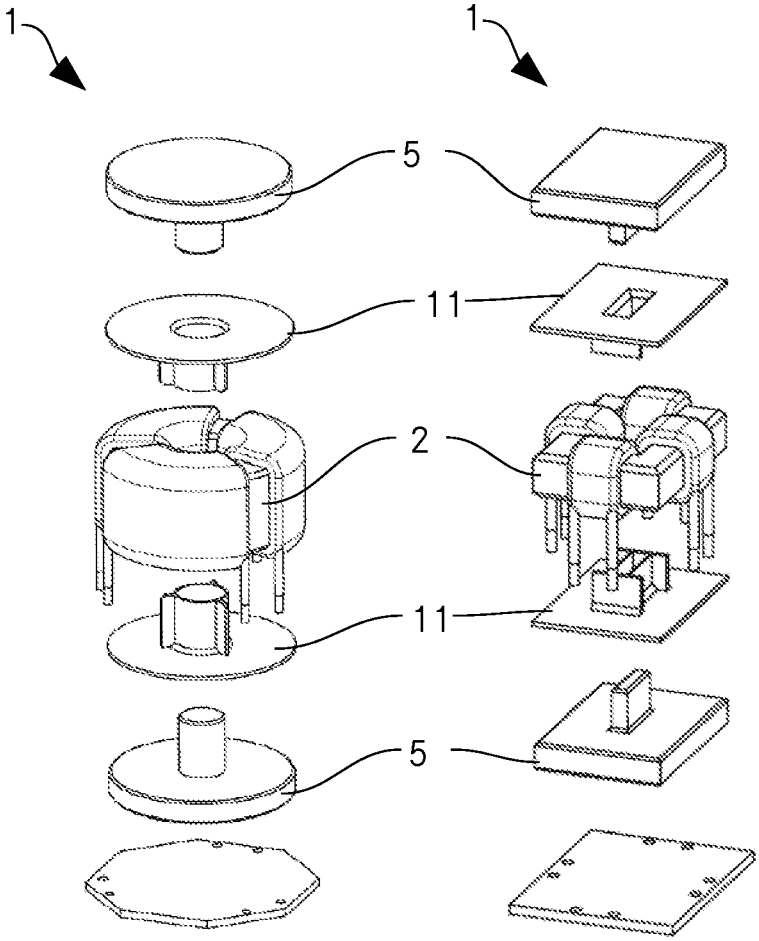

The embodiment shown in FIG. 19 differs from the embodiment shown in FIG. 17 in that the embodiment shown in FIG. 19 comprises a further circular differential mode core 5 with a rod, and in that there is a further insulator 11 comprising both a plate-shaped insulator and a tubular-shaped insulator. The two insulators 11 and the two differential mode cores 5 might be identical.

The embodiment shown in FIG. 20 differs from the embodiment shown in FIG. 18 in that the embodiment shown in FIG. 20 comprises a further rectangular differential mode core 5 with a rectangular cuboid, and in that there is a further insulator 11 comprising both a plate-shaped insulator and a rectangular-profiled insulator. The two insulators 11 and the two differential mode cores 5 might be identical.

In summary, it is to be noted that although already a plurality of different embodiments have been shown, further embodiments are possible by combining the particular features of the above presented embodiments.

The invention claimed is:

1. Integrated magnetic component, comprising;

a common mode inductance formed by a common mode core surrounding a winding window and at least two windings wound around the common mode core and through the winding window, and a differential mode inductance formed by the at least two windings and a differential mode core being spaced from the common mode core by a gap, wherein the differential mode core comprises at least one surface being adjacent to each of the at least two windings;

wherein the common mode core is a toroidal core and the differential mode core comprises a rod or a pipe arranged in the winding window;

wherein the differential mode core is fully physically separated from the common mode core; and wherein a longitudinal axis of the rod or the pipe passes through the winding window without touching or hitting the common mode core.

2. Integrated magnetic component according to claim 1, wherein the at least one surface is an edgeless surface.

3. Integrated magnetic component according to claim 1, wherein the at least one surface is adjacent to each turn of the at least two windings.

4. Integrated magnetic component according to claim 1, wherein each turn of the at least two windings is going through the gap.

5. Integrated magnetic component according to claim 1, wherein the gap has a length which is constant.

6. Integrated magnetic component according to claim 1, wherein a shortest distance between the at least one surface and each winding of the at least two windings is essentially equal to a shortest distance between the common mode core and each winding of the at least two windings.

* * * * *